US009126261B2

(12) United States Patent
Mancini

(10) Patent No.: US 9,126,261 B2
(45) Date of Patent: Sep. 8, 2015

(54) INJECTION PUMP FOR THE HOT-CHAMBER DIE CASTING OF CORROSIVE LIGHT ALLOYS

(71) Applicant: Flavio Mancini, Brescia BS (IT)

(72) Inventor: Flavio Mancini, Brescia BS (IT)

( * ) Notice: Subject to any disclaimer, the term of this patent is extended or adjusted under 35 U.S.C. 154(b) by 0 days.

(21) Appl. No.: 14/402,073

(22) PCT Filed: May 17, 2013

(86) PCT No.: PCT/IB2013/054057

§ 371 (c)(1),
(2) Date: Nov. 18, 2014

(87) PCT Pub. No.: WO2013/179177

PCT Pub. Date: Dec. 5, 2013

(65) Prior Publication Data

US 2015/0151356 A1 Jun. 4, 2015

(30) Foreign Application Priority Data

May 29, 2012 (IT) ..... MI2012A0929

(51) Int. Cl.
*B22D 17/04* (2006.01)
*B22D 17/30* (2006.01)
*B22D 17/20* (2006.01)

(52) U.S. Cl.
CPC ..... *B22D 17/04* (2013.01); *B22D 17/203* (2013.01); *B22D 17/30* (2013.01)

(58) Field of Classification Search
CPC ..... B22D 17/04; B22D 17/02
USPC ..... 164/316
See application file for complete search history.

(56) References Cited

U.S. PATENT DOCUMENTS

| | | | | |
|---|---|---|---|---|
| 3,319,702 | A * | 5/1967 | Hartwig et al. | 164/316 |
| 5,385,456 | A | 1/1995 | Mancini | |
| 6,029,737 | A | 2/2000 | Mancini | |
| 2004/0056395 | A1 | 3/2004 | Thut | |

FOREIGN PATENT DOCUMENTS

| | | | |
|---|---|---|---|
| DE | 1583714 | | 10/1971 |
| DE | 7829116 | | 1/1979 |
| EP | 0827793 | | 2/2000 |
| GB | 1207176 | A * | 9/1970 |

(Continued)

OTHER PUBLICATIONS

International Search Report issued in PCT Application No. PCT/IB2013/054057.

(Continued)

*Primary Examiner* — Kevin E Yoon
(74) *Attorney, Agent, or Firm* — Lucas & Mercanti, LLP

(57) ABSTRACT

An injection pump for the hot-chamber die casting of corrosive light alloys includes a body provided with an internal coaxial liner where an injector piston sealingly slides. The liner being made of a material resistant to the molten alloy and has a coefficient of thermal expansion different from the material of the body. Static sealing elements, made of a graphite-based non-metallic material that yields under compression, are arranged between the internal surface of the body and the external surface of the liner. The pump also has axial compression means arranged between a ring nut screwed into the body and the liner and the static sealing elements.

14 Claims, 5 Drawing Sheets

(56) References Cited

FOREIGN PATENT DOCUMENTS

| | | | | |
|---|---|---|---|---|
| IT | 1376503 | | | 10/2006 |
| JP | 55088966 | | | 7/1980 |
| JP | 57047566 | A | * | 3/1982 |
| JP | 02063660 | A | * | 3/1990 |
| JP | 3110056 | | | 5/1991 |
| JP | 03151152 | A | * | 6/1991 |
| JP | 2008006455 | | | 1/2008 |
| JP | 2008073698 | | | 4/2008 |
| WO | 2008123009 | | | 10/2008 |

OTHER PUBLICATIONS

International Preliminary Report on Patentability issued in PCT Application No. PCT/IB2013/054057.

* cited by examiner

INJECTION PUMP FOR THE HOT-CHAMBER DIE CASTING OF CORROSIVE LIGHT ALLOYS

CROSS-REFERENCE TO RELATED APPLICATIONS

This application is a 371 of PCT/IB2013/054057, filed May 17, 2013, which claims the benefit of Italian Patent Application No. MI2012A000929, filed May 29, 2012, the contents of each of which are incorporated herein by reference.

FIELD OF THE INVENTION

BACKGROUND OF THE INVENTION

The present invention concerns an injection pump for installations of hot-chamber die casting of light alloys which are corrosive in the molten or semi-liquid state, and in particular an injection pump equipped with static sealing elements that are non-metallic and yield under compression.

In injection pumps for the die casting of molten non-ferrous alloys, for the construction of the injector piston, of the container cylinder and of the dynamic sealing elements arranged therebetween there are currently employed materials resistant to high temperatures, able to withstand the corrosive action of the alloys in the molten or semi-liquid state, to resist the wear generated by the friction of the components in relative motion and to prevent or hinder the possible seizures, as well as to contain the leakage of alloy in order to obtain an economically acceptable service life of these components.

In the so-called "hot-chamber" installations, in which the injection pump is immersed in the molten alloy, there are generally used dynamic sealing elements in the form of elastic metal rings applied coaxially to the injector piston. The elastic rings have a cut in the circumferential direction that allows them to compress and expand elastically in the radial direction and are mounted coaxially to the injector piston in suitable grooves or circumferential seats formed in its lateral surface. During assembly of the injector piston in the container cylinder, the elastic rings are compressed in their seats closing on the injector piston and subsequently expand by virtue of their elasticity going in contact with the internal surface of the cylinder. The pressure generated by the sealing elements on the walls of the container cylinder determines the degree of sealing against the injection pressure of the alloy being processed, and depending on the conformation of the cut in the circumferential direction and on the conditions of operation of the injector piston (e.g. pressures and speeds) one or more elastic sealing rings can be provided.

The friction between the internal surface of the container cylinder and the dynamic sealing elements integral with the injector piston, moving fast during the injection of the molten alloy, generates considerable problems of wear of these components which cause over time defects in the sealing against the pressure and imply frequent and costly maintenance. Since the friction and wear between surfaces in relative sliding depend on the characteristics of the materials and of the coupled surfaces, as well as on the dynamic characteristics of the motion especially in terms of pressure and relative velocity, the most appropriate pairings as to shapes and materials of the components in contact are subject to continuous research and trials with the aim of maximizing their useful life.

The pairings between non-metallic materials and the mixed pairings between metallic materials and non-metallic materials are currently deeply studied and generally the wear is directed on the surfaces of the components that are easier and cheaper to replace, for example, in the case of injection pumps for die casting, the sealing elements between the container cylinder and the injector piston. However, despite numerous studies in the field (see e.g. JP 55088966), the state of the art does not yet offer a satisfactory solution to the problem of obtaining wear components with an economically acceptable service life combined with good sealing ability against pressure.

In particular, prior art pumps are not suitable for the die casting of aluminum alloys because of their very high corrosiveness, in the molten or semi-liquid state, on the metallic elements of the pumps and of their connections with the molds. For this reason, aluminum alloys are die cast only with the "cold chamber" process in spite of the undoubted advantages of the "hot chamber" process that allows to:

- inject the alloy at the same temperature of the bath that feeds the pump with temperatures, speeds and pressures much lower than the "cold chamber" process, therefore with less energy consumption and less wear of the molds;
- control the process in a closed cycle, resulting in increased productivity, improved product quality with strict repeatability of their characteristics, less rejects and less consumption of raw material;
- obtain a better microstructure of the castings without the oxidations and inclusions of gas typical of the "cold chamber" process, therefore with the possibility to weld the castings between them and with other structures and to have a better sealing towards compressed gases, in addition to expanded possibilities of heat and galvanizing treatments;
- use smaller and cheaper molds and presses;
- inject into the same mold, simultaneously or sequentially, alloys with different characteristics thus obtaining monolithic castings with component parts which greatly improve the qualities and overall performances of the casting itself, usually not obtainable from a single alloy, such as wear resistance, lightness, workability, tensile strength, impact resistance, corrosion resistance, etc.

Proposed arrangements for hot-chamber pumps for aluminum alloys are known in the art, some for decades, and some among them have been experienced by large industries, but none has entered so far in the production technology. They are usually based on ceramic components that are resistant enough to corrosion by molten aluminum, but insurmountable limitations are currently found in the poor resistance to tensile and bending stresses of these components, as well as in the high fragility and in the limits of production as to their size, shape, workability and difficulties in the connections to the metal structures of the presses, with negative consequences on the costs and risks in manufacturing and operating the pump. Similar pumps with ceramic components have been proposed, for example, by Miki Isao in EP 0827793 and by Yuji Ogawa in JP 2008006455 and JP 2008073698.

As alternative solutions, the applicant had proposed in U.S. Pat. No. 5,385,456 to make irrelevant the corrosion of the steel cylinder by using a plunger piston, possibly ceramic, subject only to compression forces, resistant to corrosion and equipped with non-metallic seals. However, this pump configuration required the use of a feed valve, which was a weak point of the solution. The applicant considered to overcome the problems of the previous configuration by proposing in U.S. Pat. No. 6,029,737 a plunger piston with grooved end, subject only to compression forces and provided with an automatic rigid seal, which has shown, however, functional problems in the pilot plant and major difficulties of maintenance.

In another alternative configuration, the injector piston can slide inside a liner in turn inserted into the body, so that when the internal surface of the liner is worn it is sufficient to change the liner instead of the entire body. For reasons of manufacturing cost, such a pump has the body made of a steel suitable to resist the tensile stresses at high temperature and with both the internal and external surfaces protected with coatings resistant to corrosion by molten aluminum as, for example, sprayed ceramic powders and binders, or other barrier layers known in the art.

For functional reasons, the steel body must be coupled to a liner which is resistant to the high tensile stresses; of a strongly impulsive nature, required by the process. The internal surface of the liner must resist the sliding of the injector piston and the corrosion by the molten alloy in order to ensure, for an economically acceptable time, the generation of the pressures required by the process of filling the mold. This liner must be easily removable from the pump body for routine maintenance, reconditioning and replacement, being able to tolerate wear of an order of magnitude lower than that of the body. Also its external surface must resist the corrosion by the molten alloy and simultaneously there is required a coupling, resistant to corrosion and high pressures, between the external surface of the liner and the pump body.

The constituent materials of the liner, which is a substantially cylindrical sleeve, may be of ceramic nature, resistant to compression stresses, or metallic nature, resistant to both compression and traction stresses. For the ceramic option some advanced ceramics have been proposed, such as e.g. silicon nitride, while for the metallic option alloys of heavy metals with high melting point have been proposed, such as molybdenum and tungsten, whose surfaces can be hardened to withstand the sliding wear as described, for example, in IT 1376503.

Whatever the material chosen for the liner among the various options above, it will have a much lower thermal expansion than the steel of the body, since making the whole pump body with the same material of the liner would entail a prohibitive cost. This makes impossible the direct coupling between the liner and the pump body according to the solutions traditionally known in the art such as, for example, the interference fit between the parts, given that the spaces generated by the greater thermal expansion of the internal surface of the body compared to the expansion of the external surface of the liner would cause intolerable leaks of molten alloy, which would prevent a proper filling of the mold cavity.

To overcome these problems various solutions have been proposed, generally referable to a frontal, flat or conical contact (e.g. U.S. Pat. No. 6,029,737) between the ceramic or metallic organs, with or without interposition of seals between the surfaces.

For example, DE 1583714 describes a solution with a gasket of expanded graphite arranged between the liner and the pump body, with a flat contact in a first embodiment and a conical contact in a second embodiment. In both cases, the pressure exerted from below on the seal by the molten alloy is countered only by an upper flange of the liner which is in turn pushed upwards by the molten alloy and held in position by an element screwed to the pump body. Due to the high cyclical injection pressures the pump body elongates and the element screwed to it shortens, moreover due to the high temperature the forces generated by the screws are very modest. It follows that the sealing effect of the gasket decreases with increasing pressure and temperature of the molten alloy, with the risk of leaks which can erode and destroy the gasket.

JP 03110056 describes instead a solution in which the seal between the liner and the pump body is provided by a pair of reverse conicity bushes arranged between said two elements without the interposition of any gasket, other three concentric elements push from above respectively the liner and the two conical bushes under the action of an upper plate. The molten alloy is fed into the space between the innermost pushing element and the intermediate pushing element, which is internally provided with a coating of graphite, ceramic or other material resistant to the molten alloy.

None of the solutions proposed so far led to the industrial development of the project due to the rapid deterioration of the sealing surfaces.

SUMMARY OF THE INVENTION

The object of the present invention is therefore to provide an injection pump which overcomes the above-mentioned drawbacks. This object is achieved by means of a pump comprising a body provided with an internal coaxial liner in which the injector piston slides, said liner being made of an anti-corrosion material having a different expansion coefficient, static sealing elements, made of a graphite-based non-metallic material that yields under compression, arranged between the internal surface of the body and the external surface of the liner, as well as axial compression means arranged between a locking element integral with the body and the liner and said static sealing elements. Other advantageous features are disclosed in the dependent claims.

The compression in the axial direction causes, by virtue of the yieldingness of the material, an expansion of the static sealing elements in the radial direction outwards against the internal surface of the pump body and inwards against the external surface of the liner, such expansion being required to contain the leakage of the alloy being processed. The degree of compression exerted by the axial compression means is preferably proportional to the injection pressure during the die casting cycle, starting from a condition of static pre-load necessary to ensure the tightness in conditions of minimum pressure.

The sealing elements are preferably made of expanded graphite, a material obtained by thermal expansion of flakes of natural graphite, which can be pressed into sheets of thin thickness, with a density lower than that of massive graphite. These sheets are suitable to be die cut according to the profiles required for the flat static seals or to be cut into bands, wrapped in a spiral, sometimes reinforced with non-metallic fibers or metal wires, and they can also be introduced into the cavity of a metal mold and pressed to get rings of significant cross-section and appropriate density. The overall process generates products of anisotropic structure, with low permeability to liquids and gases, weakly cohesive, scarcely resistant to mechanical stresses, having a plastic behavior with elastic components under compression. These products are suitable for many applications of static seals, in a non-oxidizing environment, for members at medium-high temperatures and pressures.

The above considerations and his direct experiences have prompted the applicant to study and experiment, with favorable results, the use of said material to solve the problems of corrosion resistance of the internal surface of the pump body and of the external surface of the liner, along with the problems of resistance of the liner to the impulsive pressure and of the pressure tightness of the coupling, in addition to the problems of maintenance of the pump associated with the greater or lesser ease of disassembly of the liner. The overcoming of the aforementioned problems constitutes a first important advantage of the injection pump according to the present invention, resulting from the choice of graphite as a base material for the construction of the static sealing elements and from their arrangement between the liner and the body.

Still another advantage of the injection pump according to the present invention is that the axial compression means which act on the static sealing elements can be easily adjusted in a manual and/or automatic way, allowing the periodic monitoring of the static pre-load necessary to ensure the tightness in conditions of minimum pressure.

In addition, the action of compression exerted by the axial compression means during the different phases of the die casting cycle, in certain embodiments, can be fully automated allowing the further advantage of a true optimization of the sealing degree as a function of the most important parameters of the die casting cycle.

BRIEF DESCRIPTION OF THE DRAWINGS

These and other advantages and characteristics of the injection pump according to the present invention will become apparent to those skilled in the art from the following detailed description of some embodiments thereof with reference to the attached drawings in which.

DETAILED DESCRIPTION OF THE INVENTION

Figure 1:
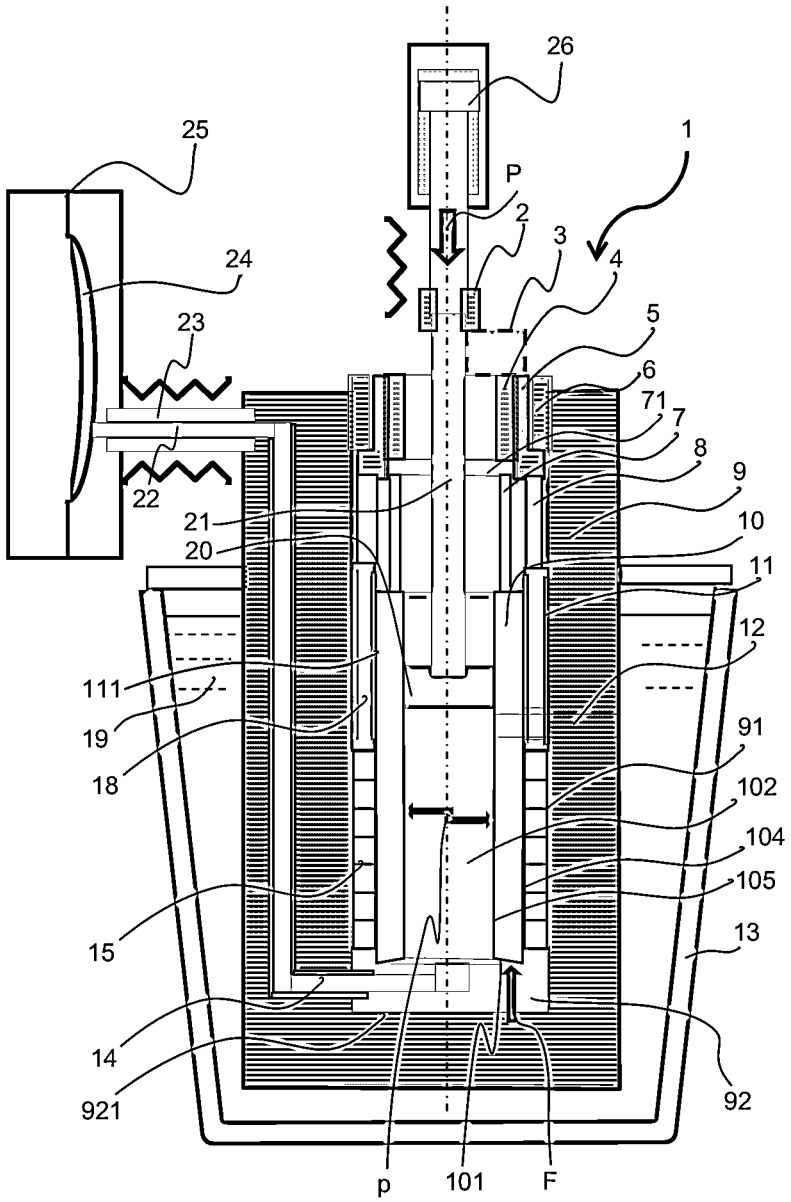
FIG. 1 shows a schematic view in longitudinal section of a first embodiment of an injection pump for the hot-chamber die casting according to the present invention.

Referring to FIG. 1, there is seen that a hot-chamber injection pump 1 according to the present invention conventionally includes a body 9 inserted in a crucible 13 and provided with an internal liner 10 coaxial therewith, in which an injector piston 20 slides moved with a reciprocating motion by an actuator 26 through a rod 21. Piston 20 has the function to push and compress into a cavity 24 of a mold 25, connected to pump 1 through a conduit 22 provided with an external heated jacket 23, a molten alloy 19 present in the injection chamber 102 formed by the interior volume of liner 10 below piston 20. The injection chamber 102 is connected to conduit 22 through a conduit 14 formed in body 9, and is in communication with the cavity of crucible 13 through a conduit 12, which passes through liner 10 and body 9, through which alloy 19 enters the injection chamber 102, usually by gravity or by suction during the return stroke of piston 20 as known in the art.

Body 9 is preferably made of a heat-resistant steel or a suitable refractory alloy, able to withstand the pressure p of the molten alloy 19 at temperatures even higher than the melting temperature of the alloy. The internal liner 10 is preferably made of ceramic material or a molybdenum alloy (or other metal alloy suitable for the purpose) with a hardened surface, able to withstand the pressure p generated by piston 20, and has an internal surface 105 able to withstand the wear caused by the sliding of piston 20. The dynamic seal between liner 10 and piston 20 can be achieved by means of any prior art system, for example by adopting the configuration described in WO 2008/123009, with the advantage that both elements 10, 20 in relative motion can be realized in the same material in order to avoid problems of different thermal expansions.

Between the internal surface 91 of body 9 and the external surface 104 of liner 10 there are interposed static sealing elements 15 made of a yielding graphite-based material, preferably expanded graphite, able to withstand the high injection pressures and temperatures and the corrosive action of the molten alloy. An innovative aspect of the present invention resides in the fact that such sealing elements 15 are suitably pre-compressed by actuator 26, which exerts an adjustable axial force P, via a ring 2 which pushes a service member 3 which in turn acts on a chain of metallic sleeves 5, 8, 18, compressing the sealing elements 15 against a base 92 that rests on the bottom 921 of body 9.

This axial pre-compression causes a radial expansion of the sealing elements 15, which generates a radial pressure suitable for the sealing of the molten alloy on the external surface 104 of liner 10 and on the internal surface 91 of body 9. This results also in a pre-tensioning of body 9, which makes it more resistant to fatigue at high temperature, and a radial pre-compression of liner 10, which makes it subject substantially only to compression stresses, which greatly expands the field of choice of its materials.

The pre-compression is maintained by blocking the axial position of the upper sleeve 5 of the chain, which is a flanged sleeve with a substantially L-section, by means of a locking member consisting of a threaded ring nut 6 which abuts on the flange of the upper sleeve 5 and is screwed into the upper part of body 9 which is internally threaded. Finally, the service member 3 is removed and pump 1 is ready for production.

The pre-compression operation must be carried out when pump 1 has reached the operating temperature in order to recover the plays arising from the thermal expansion of body 9, usually much greater than the thermal expansion of liner 10. This operation can be easily repeated to recover the wear of the components or for an adjustment different from that initially set, for example, when injection temperatures and/or pressures very different from the previous values are required.

It should be noted that during the operation of pump 1 the pressure p of the molten alloy also acts on the bottom surface 101 of liner 10 generating an upward force F; therefore to prevent the upward displacement of liner 10 the latter is locked by a spacer 7 which rests against a ring 71 whose axial position is determined by a ring nut 4 screwed into the upper sleeve 5 which is internally threaded. When you have to perform the extraction of liner 10 from body 9, just remove ring nut 6 thus releasing components 4, 5, 7, 8, 18 and then run, at full mold, an injection cycle at low speed so that force F, no longer opposed, ejects liner 10 just enough for its easy extraction from body 9. To prevent sticking and facilitate the axial sliding of the pre-compression chain, also for the extraction of liner 10, it is preferable to arrange elements of expanded graphite (or other material resistant to corrosion by the molten alloy), between the surfaces involved in the relative axial sliding, for example bushings 11 and 111 located outside and inside, respectively, of the lower sleeve 18.

Figure 2:
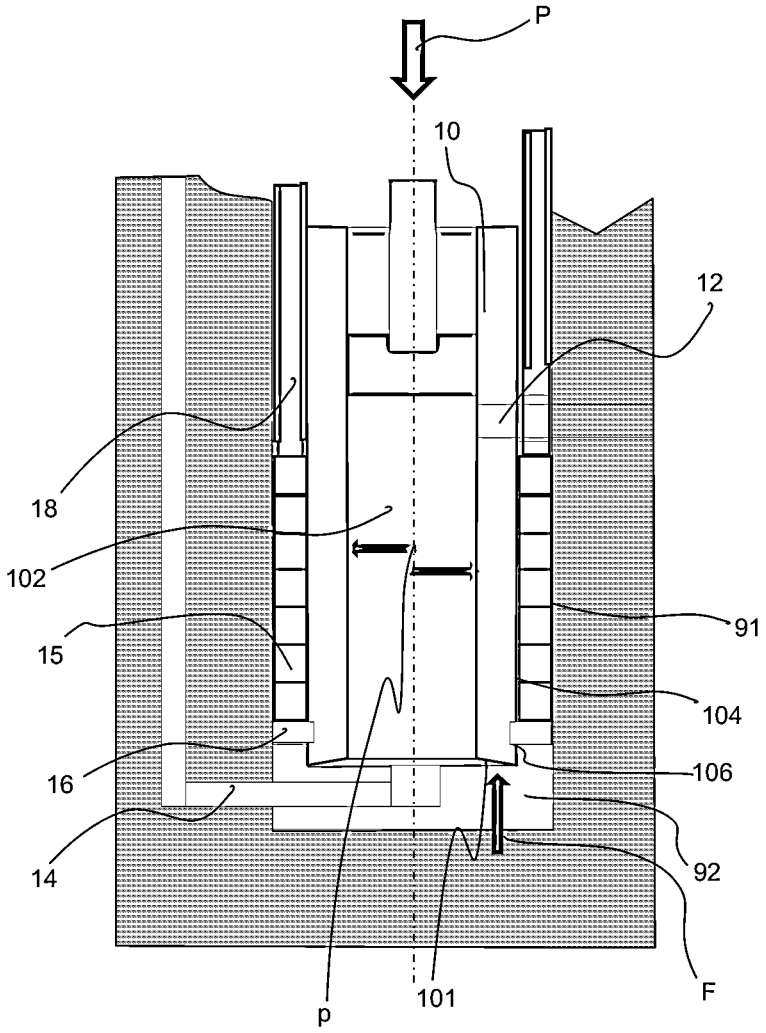
FIG. 2 shows a partial view in longitudinal section of a second embodiment of the pump of FIG. 1, provided with means for the automatic increase of the compression of the static sealing elements in proportion to the injection pressure.

FIG. 2 illustrates a second embodiment of the pump of FIG. 1, which is provided with means for the automatic increase of the compression of the static sealing elements 15 in proportion to the injection pressure p. In this configuration another innovative aspect of the present invention consists in that a metal ring 16 is disposed between the sealing elements 15 and base 92, said ring 16 being formed by two half-rings inserted in a groove formed at the base of the external surface 104 of liner 10. During the injection of the alloy in the mold, the force F generated by pressure p on the lower surface 101 of liner 10 is transferred, through the lower surface 106 of ring 16 which is inserted in said groove, to the sealing elements 15 which tend to expand radially, so that the seal of elements 15 increases with the increasing of the pressure p of the molten alloy. In order to limit the maximum pressure transferred to elements 15, the stroke of liner 10 is adjusted by means of ring nut 4 which is screwed into the upper sleeve 5 allowing to calibrate the position of spacer 7 (see FIG. 1).

Figure 3:
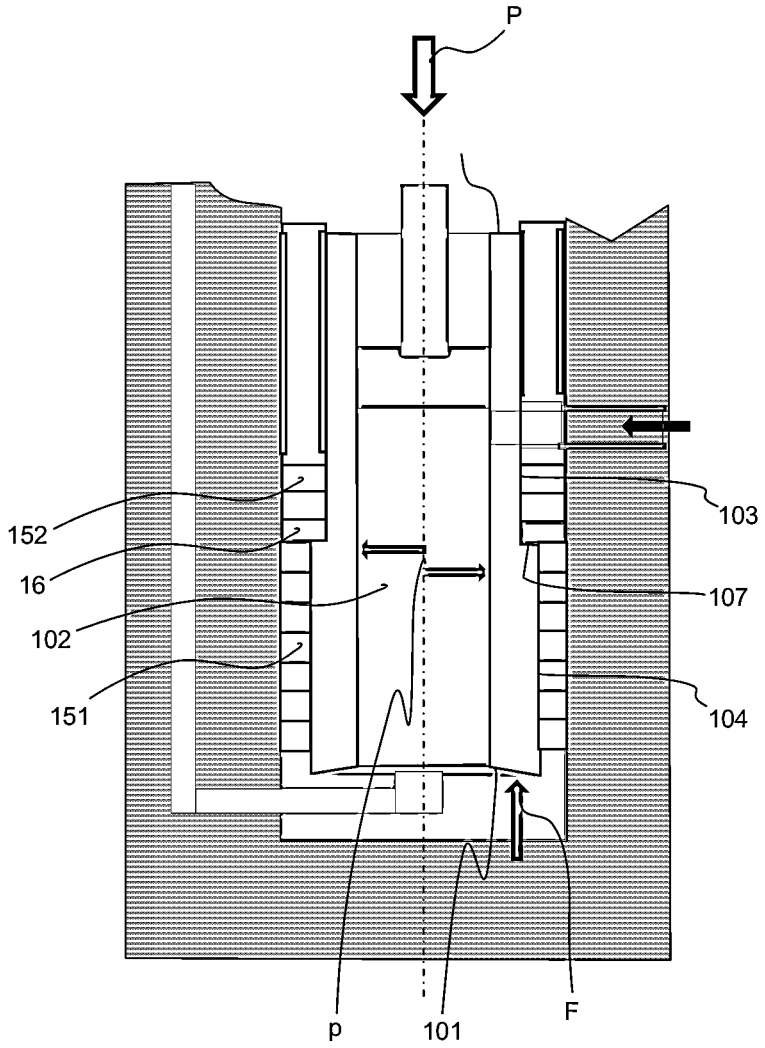
FIGS. 3 and 4 show partial views in longitudinal section of further embodiments of the pump of FIG. 1, provided with means for the automatic increase of the compression of only a part of the static sealing elements in proportion to the injection pressure.
Figure 4:
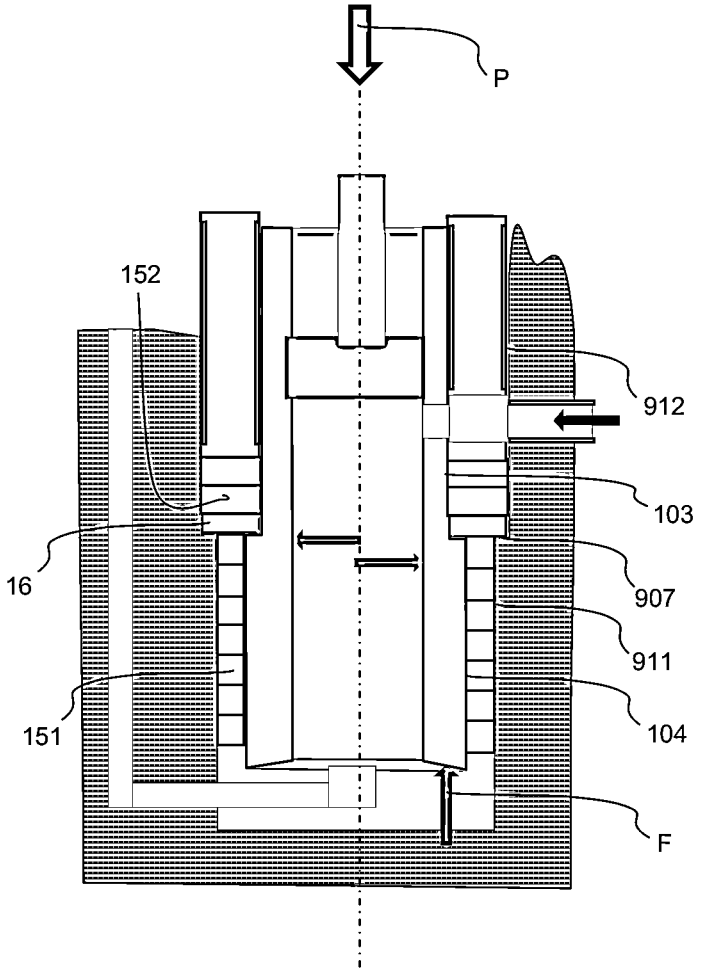

FIGS. 3 and 4 show variants of the second embodiment of FIG. 2, said variants providing that the automatic increase in the compression of the static sealing elements 15 in proportion to the injection pressure p is applied only to a portion of elements 15. To this purpose it is sufficient that ring 16 is disposed higher up along the external surface 104 of liner 10, so that some sealing elements 151 located below ring 16 do not receive the compression due to force F that is received instead by the sealing elements 152 located above the ring 16.

The positioning of ring 16 can be obtained simply by forming the relevant mounting groove higher along the external surface 104, or by adopting the configuration illustrated in the drawings in which the external surface of liner 10 is made up of a top surface 103 of smaller diameter than the bottom surface 104. The two surfaces 103, 104 are thus connected by an annular surface 107 which acts as an abutment for ring 16 for transferring force F to the overlying sealing elements 152. If you want to reduce the automatic increase of pressure on said elements 152, with the same force F, it is sufficient to increase the width of ring 16 and to this purpose it is also possible to adopt the configuration of FIG. 4 in which the internal surface of body 9 is made up of a bottom surface 911 of smaller diameter than the top surface 912. The two surfaces 911, 912 are thus connected by an annular surface 907 that serves as an additional abutment for the ring 16 of increased size.

Figure 5:
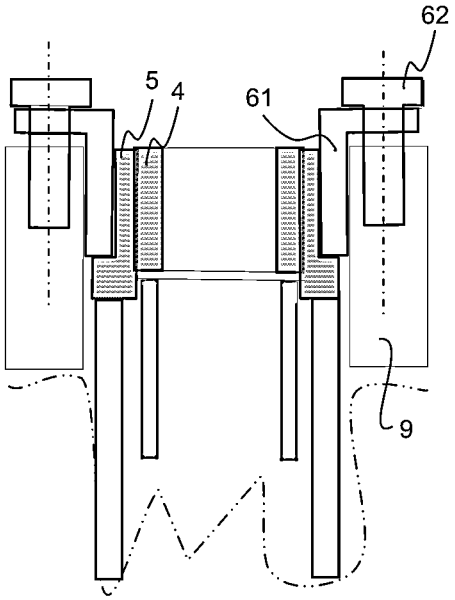
FIG. 5 shows a partial view in longitudinal section of a variant of the locking members of the axial compression means, said variant being applicable to any of the embodiments above.

Finally, FIG. 5 shows a variant of the locking member of the axial compression means, in which ring nut 6 is replaced by a lip flange 61 that is fixed, with appropriate lower spacers, by means of screws 62 screwed into body 9.

The sealing elements 15 are preferably made of expanded graphite, which is a material highly resistant to heat and well suited to the realization of sealing elements for high temperature applications, and they can be reinforced internally and/or externally with elements resistant to the molten alloy and to temperatures in the range of 600-800° C., either of non-metallic nature, such as, for example, carbon fibers, or of metallic nature provided that they are resistant to attack by the molten alloy being processed. Also the shape of the transverse cross-section has a significant importance for the good functioning of the sealing elements 15, and they preferably have a cross-section of quadrangular shape whose adjacent sides have interior angles between 30° and 150° (but they could also have a cross-section with one or more curved sides).

It is clear that the above-described and illustrated embodiments of the injection pump according to the invention are just examples susceptible of various modifications. In particular, the sealing elements 15 can be realized in a variety of forms and materials, possibly by combining in a same pump different types of them. For example, the sealing elements 15 can be cut toroidal rings (so as to obtain them from packing instead of forming them individually) optionally intercalated by annular disks of expanded graphite obtained only by die cutting without subsequent passage in the forming mold, or intercalated by disks of other suitable materials such as structural compact graphite, carbon fibers, metal, woven fibers resistant to the molten alloy and possibly reinforced with graphite or other suitable inorganic components.

The invention claimed is:

1. Injection pump for the hot-chamber die casting of corrosive light alloys comprising a body provided with an internal coaxial liner where an injector piston sealingly slides driven into a reciprocating motion by a relevant actuator (26), said liner being made of a material that resists the corrosion of said light alloys and has a coefficient of linear thermal expansion at temperatures between 300° K and 950° K which is different by at least $1.5\times10^{-6}$/° K from the coefficient of linear thermal expansion of the material of said body static sealing elements, made of a graphite-based non-metallic material that yields under compression, arranged between the internal surface of the body and the external surface of the liner; first axial compression means for the axial compression of the liner; and second axial compression means, for the axial compression of the static sealing element, arranged between a locking member integral with the body and said static sealing elements.

2. Injection pump according to claim 1, wherein it further includes a ring mounted on the external surface of the liner so as to transfer to all static sealing elements or at least to a portion thereof the force (F) generated by the pressure (p) of the molten alloy that acts on the bottom surface of the liner.

3. Injection pump according to claim 2, wherein the external surface of the liner is made up of a top surface having a diameter smaller than a bottom surface, said two surfaces being connected by an annular surface that acts as an abutment for the ring.

4. Injection pump according to claim 2, wherein the ring is made up of two half-rings introduced into a groove formed at the base of the external surface of the liner.

5. Injection pump according to claim 3, wherein the internal surface of the body is made up of a bottom surface having a diameter smaller than a top surface, said two surfaces being connected by an annular surface that acts as an additional abutment for the ring.

6. Injection pump according to claim 1, wherein the second axial compression means of the sealing elements consist of a top flanged sleeve, an intermediate sleeve and a bottom sleeve, the locking member being in abutment on the flange of said top sleeve.

7. Injection pump according to claim 6, further comprising bushings of expanded graphite located on the outside and on the inside of the bottom sleeve.

8. Injection pump according to claim 6, wherein the first axial compression means of the liner consist of a spacer resting against a ring whose axial position is defined by a ring nut screwed into the top sleeve which is internally threaded.

9. Injection pump according to claim 1, wherein the locking member consists of a threaded ring nut screwed into the top portion of the body which is internally threaded.

10. Injection pump according to claim 1, wherein the locking member consists of a lip flange that is secured through screws screwed into the body.

11. Injection pump according to claim 1, wherein the static sealing elements are made of expanded graphite and are preferably reinforced internally and/or externally with non-metallic and/or metallic members which resist the molten alloy.

12. Injection pump according to claim 1, wherein the static sealing elements are toroidal rings having a cross-section of quadrangular shape whose adjacent sides have interior angles between 30° and 150°.

13. Injection pump according to claim 1, wherein the static sealing elements are intercalated with annular disks of materials that resist the molten alloy, such as disks of expanded graphite formed only by die cutting, disks of compact structural graphite, carbon fiber disks, metal disks.

14. Injection pump according to claim 1, wherein the injector piston is driven by the relevant actuator through a stem provided with a ring suitable to act on the second axial compression means of the static sealing elements through a service member that can be removed at the end of an operation of pre-compression of said static sealing elements.

* * * * *